United States Patent [19]

Morris

[11] 4,125,171

[45] Nov. 14, 1978

[54] EXHAUST GAS SILENCER

[76] Inventor: Alberto J. Morris, Drake Lane, Dursley, England

[21] Appl. No.: 467,128

[22] Filed: May 6, 1974

[30] Foreign Application Priority Data

Aug. 23, 1973 [GB] United Kingdom ..... 39900/73

[51] Int. Cl.[2] ..... F01N 1/08

[52] U.S. Cl. ..... 181/265; 181/268; 181/276

[58] Field of Search ..... 181/36 B, 49, 53, 54, 181/56, 58, 59, 60, 63, 66

[56] References Cited

U.S. PATENT DOCUMENTS

| | | | |
|---|---|---|---|
| 2,009,343 | 7/1935 | Peik | 181/54 |
| 2,774,439 | 12/1956 | Chesser | 181/66 |
| 3,035,658 | 5/1962 | Abbüal | 181/66 |
| 3,086,611 | 4/1963 | Nelson | 181/63 |

FOREIGN PATENT DOCUMENTS

| | | | |
|---|---|---|---|
| 526,863 | 1921 | France | 181/53 |
| 547,186 | 1956 | Italy | 181/64 |
| 615,570 | 1961 | Italy | 181/54 |

*Primary Examiner*—Robert K. Schaefer
*Assistant Examiner*—Vit W. Miska
*Attorney, Agent, or Firm*—Mawhinney & Mawhinney & Connors

[57] ABSTRACT

An exhaust gas silencer having a casing including gas inlet and exhaust passages, a plurality of baffle plates having inner portions together defining a central chamber constituting one of said passages and extending longitudinally of the casing, and outer portions extending between the central chamber and the inner wall of the casing to direct the exhaust gas along a tortuous path, each outer portion meeting said inner wall along a line circumferentially spaced from any radius extending from the longitudinal axis of the central chamber through the juncture of the inner and outer portions.

7 Claims, 4 Drawing Figures

EXHAUST GAS SILENCER

The invention relates to an exhaust gas silencer of the kind in which a casing is provided with inlet and outlet passages for the exhaust gas, a plurality of baffle plates are interconnected to define a central chamber which extends longitudinally of the casing and constitutes one of said passages, the baffle plates and an inner wall of the casing jointly define a corresponding plurality of outer chambers which also extend longitudinally of the casing, and the chambers are connected in series to define a tortuous path for the exhaust gas to follow between the central chamber and the last of the outer chambers to which the outer of said passages is connected. This kind of gas silencer is particularly useful as an exhaust gas silencer for an internal combustion engine, but may also be used as a silencer for other escaping gases.

Previously proposed exhaust gas silencers of this type have their baffle plates formed so that the outer portion of each baffle plate, which extends between the central chamber and the inner wall of the casing, is flat and extends radially from the central chamber. Furthermore, the inner portion of each baffle plate, defining part of the central chamber wall, is formed either to be flat so that the central chamber will have a polygonal cross-section, or to be part cylindrical so that the central chamber will be cylindrical. These hitherto proposed constructions of baffle plates require considerable accuracy both in the formation of the individual baffle plates and in their assembly prior to positioning inside the outer casing. The rigid nature of the flat radial portions of the baffle plates can frustrate the positioning of the assembly inside the outer casing if the cross-section of the assembly is only slightly too large. Conversely, if this cross-section is slightly too small, the resultant air space hampers the spot-welding of the baffle plates to the outer casing.

An object of the present invention is to provide an improved exhaust gas silencer.

According to the invention an exhaust gas silencer, of the kind set forth, has each baffle plate comprising an inner portion defining part of the central chamber wall and an outer portion extending between the central chamber wall and the inner wall of the casing, and the outer portion of each baffle plate meets the inner wall of the casing along a line which is circumferentially spaced from any radius extending from the longitudinal axis of the central chamber through the juncture of the inner and outer portions. Preferably the outer portion of each baffle plate is curved. The outer portion of each baffle plate may extend intially radially away from its juncture with the inner portion and then curves to meet the inner wall of the casing substantially tangentially. The radius of curvature of each baffle plate is desirably within plus or minus 15% of the radius of curvature of the central chamber. The outer portion of each baffle plate may be flexible radially of the central chamber for resiliently engaging the inner wall of the chamber.

According to another aspect of the invention, the inner portion of each baffle plate may be shaped so that the central chamber wall is non-cylindrical and extends between the outer portions of each adjacent pair of baffle plates to a position closer to the inner wall of the casing than the juncture of the inner and outer portions of these baffle plates. The eccentricity of the central chamber wall may be approximately equal to one quarter of the radius of the notional cylinder on the surface of which lie the junctures of the inner and outer portions of each baffle plate. The chambers may be interconnected by apertures which are progressively reduced in area in the direction of gas flow.

The central chamber may be closed at one end and have the opposite end open to define the inlet passage for receiving the exhaust gas, and the first of the outer chamber being connected to the central chamber adjacent its open end. The casing may define one or more apertures constituting said outlet passage for the exhaust gas to escape from the last outer chamber.

Alternatively, the central chamber may be blocked intermediate its ends and have one end open to receive the exhaust gas to be discharged through one or more outlet apertures into the first of the outer chambers, the last of the outer chambers being connected by one or more outlet apertures to discharge the exhaust gas through the other end of the central chamber.

According to a further aspect of the invention, the method of manufacturing an exhaust gas silencer of the kind set forth includes securing the baffle plates together as a sub-assembly with the inner portions defining the central chamber wall and with their outer portions extending outwardly from the central chamber wall to such an extent that the subassembly is slightly too large to fit into the casing, and resiliently deforming the outer portions of the baffle plates inwardly until the sub-assembly can be fitted into the casing so that the outer portions of the baffle plates will resiliently engage the inner wall of the chamber.

The invention as applied to an exhaust gas silencer for an internal combustion engine is now described, by way of example only, with reference to the accompanying drawings, in which.

Figure 1:
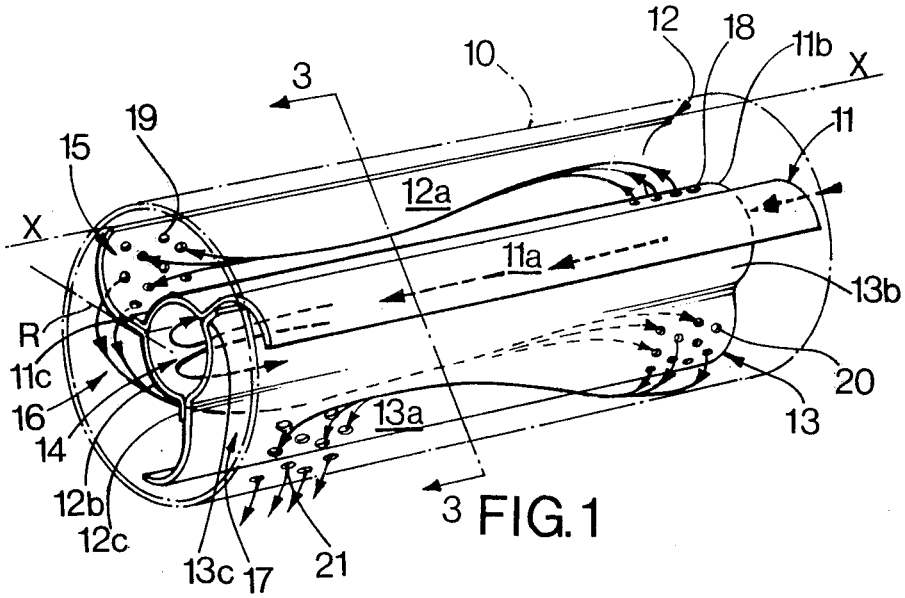
FIG. 1 is a perspective view of one form of exhaust gas silencer showing the assembly of the baffle plates and the gas flow path.

Referring to FIG. 1, an exhaust gas silencer is provided with a cylindrical casing 10 which has been shown in chain dotted lines to reveal the interior of the silencer. Secured inside the cylindrical casing is a sub-assembly formed from three similar baffle plates 11, 12 and 13. Each baffle plate is formed as a sheet steel pressing to define an outer portion 11*a*, 12*a* or 13*a* respectively, an inner portion 11*b*, 12*b* or 13*b* respectively, and a flange 11*c*, 12*c* or 13*c* respectively. The three baffle plates are secured together by welding or spot-welding the flange 11*c* of baffle plate 11 to the outer portion 12*a* of the baffle plate 12 adjacent its juncture with the inner portion 12*b*, the baffle plate 12 being similarly joined to the baffle plate 13 by welding the flange 12*c* to the outer portion 13*a*, and the baffle plate 13 being similarly joined to the baffle plate 11 by welding the flange 13*c* to the outer portion 11*a*.

The inner portions 11*b*, 12*b* and 13*b* are each formed as a 120° segment of a cylinder so that the sub-assembly of the baffle plates 11, 12 and 13 define a central cylindrical chamber 14. The outer portions 11*a*, 12*a* and 13*a* are also pressed to a similar cylindrical curvature conveniently by using the same press tool. However, the curvature of the outer portions can be varied. although it is preferably within plus or minus 15% of the radius of the central cylindrical chamber 14.

After the baffle plates 11, 12 and 13 have been welded together they are introduced into the cylindrical casing 10 and the outermost edges of the outer portions 11*a*, 12*a* and 13*a* are conveniently secured to the inner wall of the casing by spot-welding. In this manner the central cylindrical chamber 14 is positioned longitudinally of the casing 10 and the baffle plates 11, 12, and 13 jointly define with the inner wall of the casing 10 three outer chambers 15, 16 and 17. The left-hand end of the cylindrical casing 10 is closed by an unshown dish-shaped end plate which is welded or swaged in position and completely seals off the left-hand ends of the central chamber 14 and the outer chambers 15, 16 and 17. The right-hand end of the cylindrical casing 10 is similarly closed with the exception that the end plate has a central orifice providing access to the right-hand end of the central chamber 14 which is connected to receive the exhaust gas to be silenced.

As shown by the dotted arrows, the exhaust gas enters the central chamber 14 from the right-hand side and flows for the full length of the central chamber 14 until its direction is reversed by the left-hand end plate. The exhaust gas then passes back towards the inlet end of the central chamber 14 and then passes through a series of apertures 18 formed through the inner portion 11*b* of the baffle plate 11. In this manner the exhaust gases pass into the outer chamber 15 and then flow to the left for the full length of the chamber until they escape through apertures 19 formed in the outer portion 12*a* of baffle plate 12. From the apertures 19 the gases flow into the outer chamber 16 and then have to flow to the right for the full length of the silencer until they escape through apertures 20 formed in outer portion 13*a* of baffle plate 13. From the apertures 20 the exhaust gases flow into the outer chamber 17 and then flow to the left for the full length of the silencer until they escape to atmosphere through apertures 21 formed through the wall of the casing 10. It will therefore be noted that the chambers 14, 15, 16 and 17 are connected in series and define a tortuous path for the gas to flow between the exhaust inlet at the right-hand end of the central chamber 14 and the outlet apertures 21. Furthermore, between each of the chambers, the gases change both axial and angular direction. The apertures 18, 19, 20 and 21 are preferably progressively reduced in area in the direction of gas flow as the flow fluctuations become smaller as the gases expand into successive chambers.

Due to the curved profile of the outer portion 12*a* of baffle plate 12, it will be noted that it meets the inner wall of the casing 10 along the line XX which is circumferentially spaced from a radius R extending from the longitudinal axis of the central chamber through the juncture of the outer portion 12*a* and the inner portion 12*b*. This relationship also holds true for the outer portions 11*a* and 13*a*. This construction provides considerable advantages over previously proposed arrangements. As each of the outer portions 11*a*, 12*a* and 13*a* are radially flexible, it is feasible to make the sub-assembly of the baffle plates 11, 12 and 13 of a slightly larger diameter than the internal diameter of the casing 10 so that the outer portions 11*a*, 12*a* and 13*a* will be resiliently deformed inwardly when inserted into the casing 10. This ensures that the sub-assembly of the baffle plates 11, 12 and 13 fits tightly all round into the casing 10 and also facilitates the spot-welding of the outer portions 11*a*, 12*a* and 13*a* to the casing 10. Due to this flexibility of the outer portions 11*a*, 12*a* and 13*a*, the fabrication of the sub-assembly of the baffles 11, 12 and 13 requires a lesser degree of accuracy than previous proposals. Furthermore, the outer portions 11*a*, 12*a* and 13*a* are not so prone to vibration after they have been secured to the inner wall of the casing 10 as previously proposed flat radial partitions, and the baffles 11, 12 and 13 increase the stiffness of the cylindrical casing 10 thereby inhibiting it from resonating.

This construction of the baffle plates also has the advantage that the apertures 19 and 20 direct the exhaust gases towards the outer casing 10 and this change of direction improves the noise reduction of the silencer. Furthermore, the outer portions 11*a*, 12*a* and 13*a* are of greater length between the central chamber 14 and the casing 10 than the previously proposed radial partitions, and this enables a given number of holes of a given size to be positioned closer to the ends of the silencer than is possible with a truly radial partition, and thereby increases the effective distance for a given length of silencer that the gases have to travel from one end of the silencer to the other as they go through the chambers. As the radius of curvature of the outer portions is similar to the radius of curvature of the inner portions, the apertures 18, 19 and 20 can now be punched with the same tool after the sections have been pressed into shape. Although the outer portions 11*a*, 12*a* and 13*a* are curved as shown, they could if desired be curved or formed to different shapes.

Figure 2:
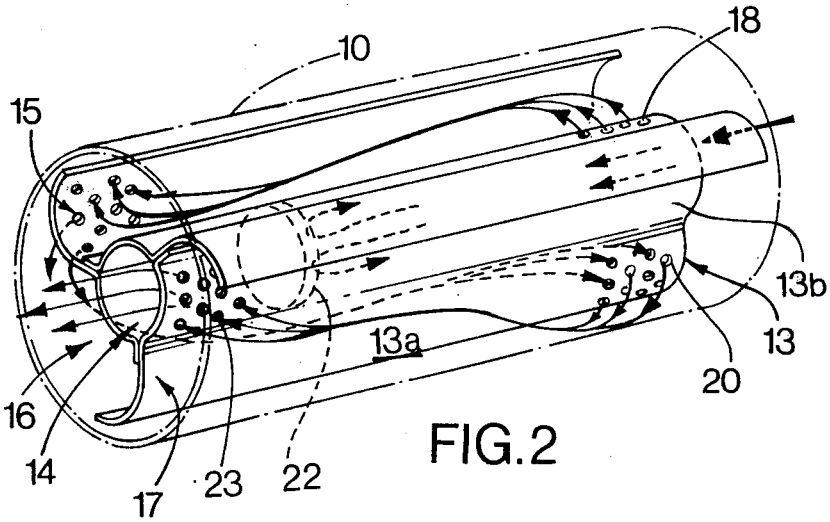
FIG. 2 is a perspective view similar to FIG. 1 but illustrating a different flow path.

The construction shown in FIG. 2 is generally similar to FIG. 1 and accordingly only the points of difference will be described. The central cylindrical chamber 14 is blocked a short distance from its left-hand end by a plug 22 so that the exhaust gases entering the right-hand end of the central chamber 14 are deflected by the plug 22 and then flow through the apertures 18 as before. The gases then flow through the chambers 15 and 16 into the chamber 17 as previously described. However, the apertures 21 provided through the outer casing 10 of the FIG. 1 embodiment are omitted, and the gases now escape from chamber 17 through a new set of apertures 23 which are formed through the inner portion 13*b* of the baffle plate 13 to the left-hand side of the plug 22. The unshown dish-shaped end plate closing the left-hand end of the casing 10 is provided with a central aperture to allow the exhaust gases to escape to atmosphere through the left-hand end of the central chamber 14. Although the embodiments shown in FIGS. 1 and 2 have three baffle plates 11, 12 and 13 defining three outer chambers 15, 16 and 17, difference numbers of baffle plates can be used if desired. With the apertures 18 formed in the position shown, an uneven number of baffle plates will result in the exhaust gases leaving the silencer at the left-hand end as shown. On the other hand, an even number of baffle plates will mean that the exhaust gases would preferably leave the casing 10 at its right-hand end. Although the apertures 18 are preferably in the position shown, they could if desired be moved to the left-hand end of the central chamber 14.

Figure 3:
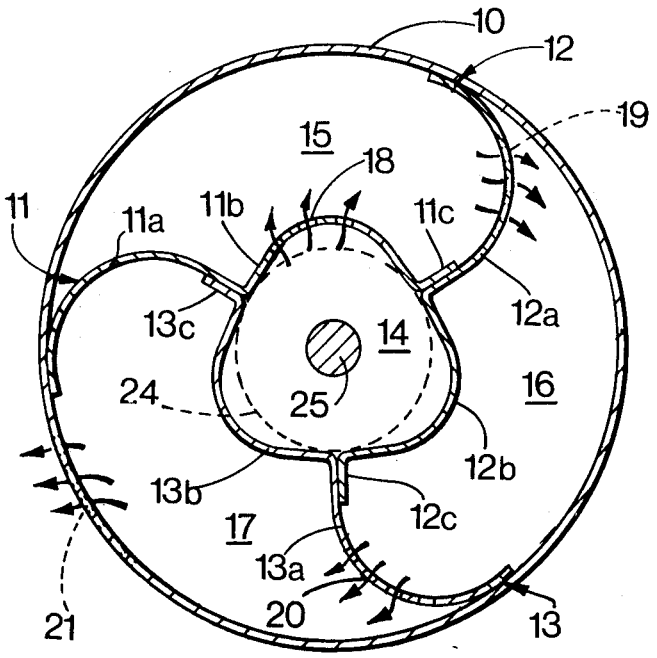
FIG. 3 is a cross-section as if taken through FIG. 1 on the line 3—3 but illustrating a further modification.

FIG. 3 shows an enlarged section through a silencer similar to that shown in FIG. 1 and the same reference numerals have been utilised to denote similar components. As shown, the path the exhaust gas follows from chamber 14 through chambers 15, 16 and 17 to atmosphere is the same as described with reference to FIG. 1. The point of difference is that the inner portions 11*b*, 12*b* and 13*b* of the baffles 11, 12 and 13 are pressed to a different shape so that the wall of the central chamber 14 is non-cylindrical. Reference 24 indicates the end of a notional cylinder fitting closely within the central chamber 14, and it will be noted that each of the inner portions 11*b*, 12*b* and 13*b* project eccentrically beyond the notional cylinder 24 by an amount which is approximately equal to one quarter of the radius of the notional cylinder 24. With this construction, the inner portions 11*b*, 12*b* and 13*b* extend closer to the inner wall of the casing 10 than their junctures with the corresponding outer portions 11*a*, 12*a* and 13*a* and form corresponding restrictions to the circumferential flow in each of the outer chambers, 15, 16 and 17. These restrictions are beneficial in increasing the noise reduction properties of the silencer, and the non-cylindrical shape of the chamber 14 also has advantageous effects in reducing noise during the first or "snubbing" stage of the silencing action. Another advantage is that the volume of the central chamber 14 is increased without reducing the area of the outer portions 11*a*, 12*a* and 13*a* of the baffle plates 11, 12 and 13 available for the apertures 19 and 20.

Figure 4:
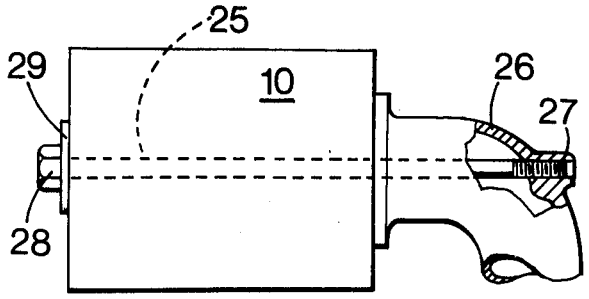
FIG. 4 illustrates the manner in which the silencers of FIGS. 1 and 3 can be secured to an exhaust manifold.

A stud 25 extends through the centre of the central chamber 14 for securing the silencer to a manifold 26 as shown in FIG. 4. The stud is secured to the manifold 26 by threads 27, and the silencer is held in place by a nut 28 engaging a sealing washer 29 which bears against the end plate of the silencer. The diameter of the washer 29 is arranged to be slightly greater than the diameter of the central cylindrical chamber 14 so that the compression load applied by the stud 25 to the silencer is transmitted to the wall of the chamber 14 by the washer 29 and the manifold 26. This mounting arrangement is particularly advantageous with the silencer shown in FIG. 1, as the outlet apertures 21 can be arranged to discharge the exhaust gases to atmosphere in any selected radial direction from the axis of the stud merely by appropriately rotating the silencer about the stud before finally tightening the nut 28. A similar mounting arrangement can be used with the embodiment of FIG. 2 by securing the stud 25 through a hole in the plug 22. If desired, the silencer can be mounted in any other known manner.

What I claim as my invention and desire to secure by Letters Patent of the United States is:

1. An exhaust gas silencer comprising a tubular casing defining an inner wall, a plurality of baffle plates arranged in said casing, each baffle plate comprising an inner portion and an outer portion, said inner portions defining a central chamber extending longitudinally of the tubular casing, the outer portion of each baffle plate extending between the central chamber and said inner wall to meet the inner wall along a line which is circumferentially spaced from any radius extending from the longitudinal axis of the central chamber through the juncture of the inner and outer portions of the baffle plate, a curved surface defined by said outer portion, said curved surface extending from a position adjacent said juncture to said line to meet the inner wall of said casing substantially tangentially, a plurality of outer chambers defined jointly by said inner wall and said baffle plates to extend longitudinally of said casing, said chambers connected in series to define a tortuous path for exhaust gas to follow between the central chamber and the last chamber of said series connected outer chambers, an inlet passage and an outlet passage defined by said exhaust gas silencer, one of said passages communicating with said central chamber, and the other of said passages communicating with said last chamber and in which the inner portion of each baffle plate extends between the outer portions of each adjacent pair of baffle plates to a position closer to the inner wall of said casing than said junctures and in which the eccentricity of the central chamber wall is approximately equal to one quarter of the radius of a notional cylinder on the surface of which lie said junctures of the inner and outer portions of each baffle plate.

2. An exhaust gas silencer comprising a tubular casing defining an inner wall, a plurality of baffle plates arranged in said casing, each baffle plate comprising an inner portion and an outer portion, said inner portions defining a central chamber extending longitudinally of the tubular casing, the outer portion of each baffle plate extending between the central chamber and said inner wall to meet the inner wall along a line which is circumferentially spaced from any radius extending from the longitudinal axis of the central chamber through the juncture of the inner and outer portions of the baffle plate, a curved surface defined by said outer portion, said curved surface extending from a position adjacent said juncture to said line to meet the inner wall of said casing substantially tangentially, a plurality of outer chambers defined jointly by said inner wall and said baffle plates to extend longitudinally of said casing, said chambers connected in series to define a tortuous path for exhaust gas to follow between the central chamber and the last chamber of said series connected outer chambers, an inlet passage and an outlet passage defined by said exhaust gas silencer, one of said passages communicating with said central chamber, and the other of said passages communicating with said last chamber and in which one end of the central chamber is open to define said inlet passage, and the opposite end of the central chamber is closed, the first of said outer chambers communicating with said central chamber adjacent said one end.

3. An exhaust gas silencer comprising a tubular casing defining an inner wall, a plurality of baffle plates arranged in said casing, each baffle plate comprising an inner portion and an outer portion, said inner portions defining a central chamber extending longitudinally of the tubular casing, the outer portion of each baffle plate extending between the central chamber and said inner wall to meet the inner wall along a line which is circumferentially spaced from any radius extending from the longitudinal axis of the central chamber through the juncture of the inner and outer portions of the baffle plate, a curved surface defined by said outer portion, said curved surface extending from a position adjacent said juncture to said line to meet the inner wall of said casing substantially tangentially , a plurality of outer chambers defined jointly by said inner wall and said baffle plates to extend longitudinally of said casing, said chambers connected in series to define a tortuous path for exhaust gas to follow between the central chamber and the last chamber of said series connected outer chambers, an inlet passage and an outlet passage defined by said exhaust gas silencer, one of said passages communicating with said central chamber, and the other of said passages communicating with said last chamber and in which a member is positioned within the central chamber intermediate its ends to prevent the direct flow of exhaust gas between the ends of the central chamber, one end of the central chamber being open to receive the exhaust gas to be discharged into the first chamber of said series, and the other end of the central chamber being open to discharge the exhaust gas to be received from the last chamber of said series.

4. An exhaust gas silencer comprising a tubular casing defining an inner wall, a plurality of baffle plates arranged in said casing, each baffle plate comprising an inner portion and an outer portion, said inner portions defining a central chamber extending longitudinally of the tubular casing, the outer portion of each baffle plate extending between the central chamber and said inner wall, a plurality of outer chambers defined jointly by said inner wall and said baffle plates to extend longitudinally of said casing, said chambers connected in series to define a tortuous path for exhaust gas to follow between the central chamber and the last chamber of said series connected outer chambers, an exhaust gas inlet defined by one end of said central chamber, a central chamber closure member arranged remote from said one end of the central chamber, the first of said outer chambers communicating with said central chamber adjacent said one end, and an outlet passage defined by said exhaust gas silencer communicating with said last outer chamber.

5. An exhaust gas silencer as in claim 4, in which the closure member is positioned at the opposite end of said central chamber to said one end.

6. An exhaust gas silencer as in claim 4, in which said outlet passage is defined by the wall of said tubular casing.

7. An exhaust gas silencer as in claim 4, in which the closure member is positioned within the central chamber intermediate its ends to prevent the direct flow of exhaust gas between the ends of the central chamber, and the opposite end of the central chamber to said one end is open to discharge the exhaust gas to be received from the last chamber of said series.

* * * * *